US012247474B2

(12) United States Patent
Demirer et al.

(10) Patent No.: US 12,247,474 B2
(45) Date of Patent: Mar. 11, 2025

(54) AUTOMATED VERTICAL-CURVE-LATERAL DRILLING

(71) Applicant: Halliburton Energy Services, Inc., Houston, TX (US)

(72) Inventors: Nazli Demirer, Houston, TX (US); Robert P. Darbe, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 19 days.

(21) Appl. No.: 18/082,235

(22) Filed: Dec. 15, 2022

(65) Prior Publication Data

US 2023/0272704 A1 Aug. 31, 2023

Related U.S. Application Data

(60) Provisional application No. 63/340,556, filed on May 11, 2022.

(51) Int. Cl.
*E21B 44/00* (2006.01)
*E21B 7/04* (2006.01)

(52) U.S. Cl.
CPC ..... *E21B 44/00* (2013.01); *E21B 7/04* (2013.01); *E21B 2200/20* (2020.05)

(58) Field of Classification Search
CPC ..... E21B 44/00; E21B 7/04; E21B 2200/20
USPC ..... 175/45
See application file for complete search history.

(56) References Cited

U.S. PATENT DOCUMENTS

| | | | | |
|---|---|---|---|---|
| 10,883,341 | B2 | 1/2021 | Demirer et al. | |
| 11,326,441 | B2 | 5/2022 | Gu et al. | |
| 2004/0216921 | A1 | 11/2004 | Krueger | |
| 2007/0221375 | A1 | 9/2007 | Baron et al. | |
| 2016/0160628 | A1 | 6/2016 | Sugiura et al. | |
| 2016/0265334 | A1* | 9/2016 | Dykstra | E21B 44/02 |
| 2017/0335671 | A1* | 11/2017 | Dykstra | E21B 41/00 |
| 2020/0040720 | A1 | 2/2020 | Zalluhoglu et al. | |
| 2020/0072034 | A1 | 3/2020 | Zalluhoglu et al. | |
| 2020/0248508 | A1 | 8/2020 | Summers et al. | |
| 2020/0318471 | A1* | 10/2020 | Papouras | E21B 41/00 |
| 2021/0103843 | A1 | 4/2021 | Keller et al. | |
| 2021/0348924 | A1 | 11/2021 | Xue | |
| 2022/0120170 | A1 | 4/2022 | Marck et al. | |
| 2022/0372861 | A1 | 11/2022 | Wu et al. | |

OTHER PUBLICATIONS

International Search Report and Written Opinion for International Patent Application No. PCT/US2023/010990 dated Jan. 18, 2023.

* cited by examiner

*Primary Examiner* — Taras P Bemko
(74) *Attorney, Agent, or Firm* — Benjamin Ford; C. Tumey Law Group PLLC

(57) ABSTRACT

A method may include dividing a wellplan into one or more section using a section detection algorithm, receiving a depth measurement of a drill bit or a bottom hole assembly located in a wellbore, utilizing the section detection algorithm and the depth measurement to identify a section of the wellplan from the one or more sections of the wellplan, and identifying a target based at least in part on the identified section. The method may further include determining one or more steering commands based at least in part on the target and a control algorithm and steering the bottom hole assembly to the target using the one or more steering commands.

18 Claims, 7 Drawing Sheets

AUTOMATED VERTICAL-CURVE-LATERAL DRILLING

CROSS-REFERENCED TO RELATED APPLICATIONS

The present application is a non-provisional of U.S. Patent Application No. 63/340,556, filed on May 11, 2022, the entire disclosure of which is incorporated herein by reference.

BACKGROUND

The oil and gas industry may use wellbores as fluid conduits to access subterranean deposits of various fluids and minerals which may include hydrocarbons. There may be a direct correlation between the productivity of a wellbore and the interfacial surface area through which the wellbore intersects a target subterranean formation. For this reason, it may be economically desirable to increase the length of a drilled section within a target subterranean formation by means of extending a horizontal, slant-hole, or deviated wellbore through the target subterranean formation. Additionally, horizontal, slant-hole, and deviated drilling techniques may be utilized in operational contexts where the surface location is laterally offset from the target subterranean formation such that the target subterranean formation may not be accessible by vertical drilling alone.

Due to leasing restrictions associated with developing a subterranean asset it may be important to pre-plan and adhere to a specific wellbore trajectory in order to maximize the extended length of the wellbore through the target subterranean formation. Additionally, constructing a smooth wellbore profile may be a priority if further operations may be utilized to complete and produce the well. Unintentional departures from the planned wellbore trajectory, which may include "bit walking," may result in hole deviations. In non-limiting terms, hole deviations may be caused by geological heterogeneity, property variations in geological layers, formation dip angles, geological folding and faulting, drill-bit type, bit hydraulics, improper hole cleaning, drill string characteristics, high ROP, and human error. Unplanned hole deviations may result in "wellbore tortuosity," which may in the very least create problems with future well operations including the placement and utilization of casing, completion tools, logs, and/or production and artificial lift equipment.

BRIEF DESCRIPTION OF THE DRAWINGS

These drawings illustrate certain aspects of some examples of the present disclosure and should not be used to limit or define the disclosure.

DETAILED DESCRIPTION

This disclosure details methods and systems for automating the steering control for vertical-curve-lateral (VCL) drilling. With use of multi-purpose smart drilling tools which may achieve high-DLS curves as well as straight sections with tight tolerances, single-trip VCL drilling applications have gained great importance. As discussed below, the method may utilize a reference wellplan where the wellplan is divided into vertical, tangent, curve, and lateral sections based on a section detection algorithm based on predetermined criteria. The section detection algorithm may operate in real-time during drilling operations to detect and categorize a current section of a wellbore based at least in part on a reference wellplan and bit depth. In some examples, the section detection algorithm may be either a partially- or a fully automated algorithm. As described herein, real-time may be generally understood to relate to a system, apparatus, or method in which a set of input data is processed and available for use when new survey information is acquired. In some examples, once the new survey information is acquired the data may be processed and available for use within 100 milliseconds ("ms") to 1 second. Once the current section of the wellbore is detected and categorized, a control algorithm may establish the control parameters according to an objective which may be defined according to the current section and/or transition point. In some examples, the control algorithm may be either a partially- or a fully automated algorithm. In some examples, the control algorithm may automatically set the next target and adjust the control constraints on position, attitude, walk rate, build rate, and/or curvature. Given the target and the objective, the constraints and the suitable control algorithm may be selected and run to provide steering recommendations. As discussed below, suitable control algorithms may include model-based control algorithms and model-free control algorithms. The steering recommendations may be used to direct a drill bit in order to extend a drill string through a subterranean formation in accordance with a wellplan.

Figure 1:
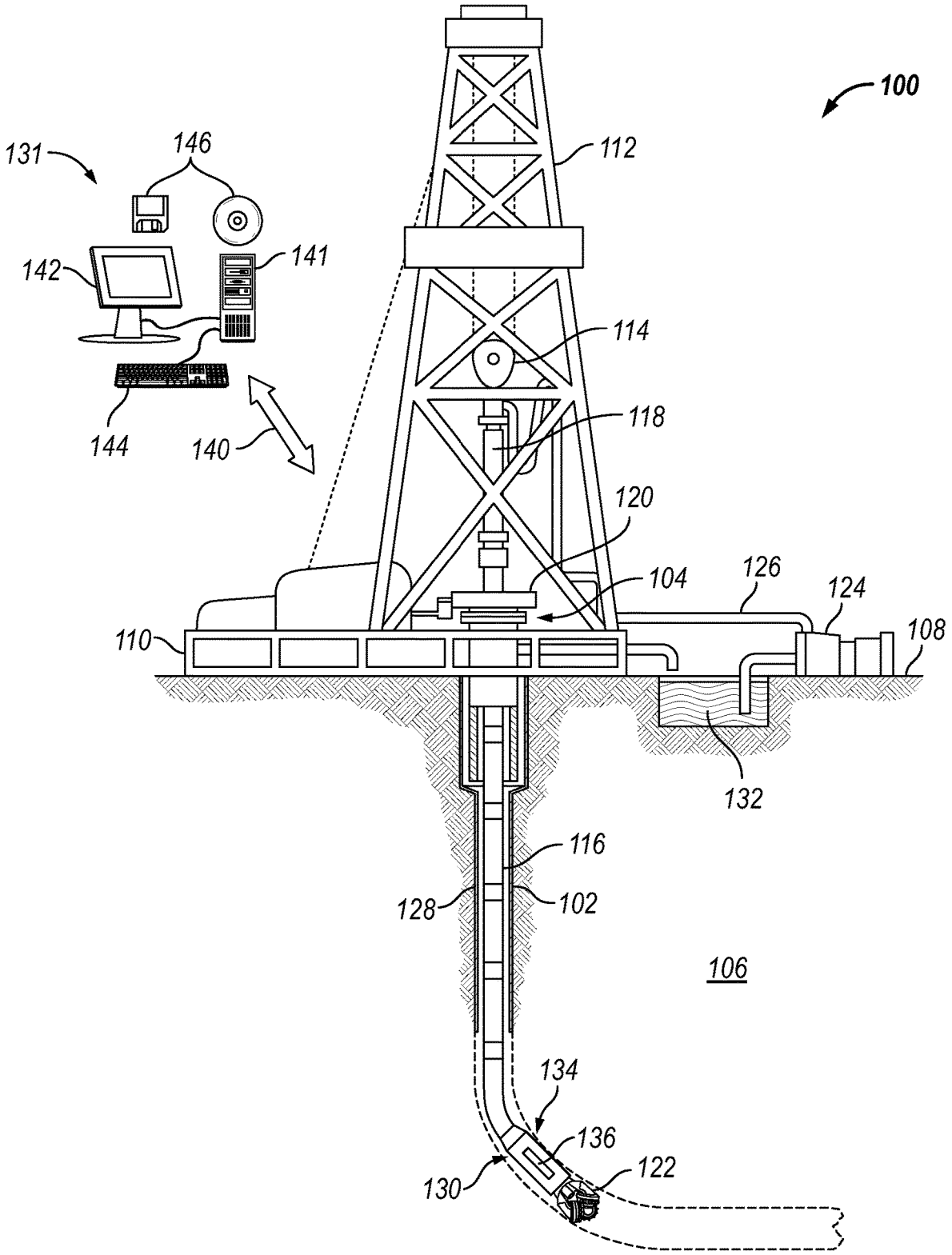
FIG. 1 illustrates an example of a drilling system and operation.

FIG. 1 illustrates an example of drilling system 100. As illustrated, wellbore 102 may extend from a wellhead 104 into a subterranean formation 106 from a surface 108. Generally, wellbore 102 may include horizontal, vertical, slanted, curved, and other types of wellbore geometries and orientations. Wellbore 102 may be cased or uncased. In examples, wellbore 102 may include a metallic member. By way of example, the metallic member may be a casing, liner, tubing, or other elongated steel tubular disposed in wellbore 102.

As illustrated, wellbore 102 may extend through subterranean formation 106. As illustrated in FIG. 1, wellbore 102 may extend generally vertically into the subterranean formation 106, however, wellbore 102 may extend at an angle through subterranean formation 106, such as horizontal and slanted wellbores. For example, although FIG. 1 illustrates a vertical or low inclination angle well, high inclination angle or horizontal placement of the well and equipment may be possible. It should further be noted that while FIG. 1 generally depicts land-based operations, those skilled in the art may recognize that the principles described herein are equally applicable to subsea operations that employ floating or sea-based platforms and rigs, without departing from the scope of the disclosure.

As illustrated, a drilling platform 110 may support a derrick 112 having a traveling block 114 for raising and lowering drill string 116. Drill string 116 may include, but is not limited to, drill pipe and coiled tubing, as generally known to those skilled in the art. A kelly 118 may support drill string 116 as it may be lowered through a rotary table 120. A drill bit 122 may be attached to the distal end of drill string 116 and may be driven either by a downhole motor, a rotary steerable system ("RSS"), and/or via rotation of drill string 116 from surface 108. Without limitation, drill bit 122 may include, roller cone bits, PDC bits, natural diamond bits, any hole openers, reamers, coring bits, and the like. As drill bit 122 rotates, it may create and extend wellbore 102 that penetrates various subterranean formations 106. A pump 124 may circulate drilling fluid through a feed pipe 126 through kelly 118, downhole through interior of drill string 116, through orifices in drill bit 122, back to surface 108 via annulus 128 surrounding drill string 116, and into a retention pit 132.

With continued reference to FIG. 1, drill string 116 may begin at wellhead 104 and may traverse wellbore 102. Drill bit 122 may be attached to a distal end of drill string 116 and may be driven, for example, either by a downhole motor and/or via rotation of drill string 116 from surface 108. In a non-limiting example, the weight of drill string 116 and bottom hole assembly may be controlled and measured while drill bit 122 is disposed within wellbore 102. In further examples, drill bit 122 may or may not be in contact with the bottom of wellbore 102. Drill bit 122 may be allowed to contact the bottom of wellbore 102 with varying amounts of weight applied to drill bit 122. The weight of drill string 116 may be measured at the surface of wellbore 102 and may be referred to as the "hook load." The difference in the hook load when drill bit 122 is suspended just above the bottom of wellbore 102 and the hook load when drill bit 122 is in contact with the bottom of wellbore 102 may be referred to as the weight-on-bit ("WOB"). Both the hook load and the weight-on-bit may be considered drilling parameters. In some examples the hook load may be measured by a hoisting system or a hook load sensor. In some examples, the hook load is measured at the surface by a sensor disposed at the surface of drilling system 100. Drill bit 122 may be a part of bottom hole assembly 130 at the distal end of drill string 116. In some examples, bottom hole assembly 130 may further include tools for directional drilling applications. In other examples, directional drilling tools may be disposed anywhere along the drill string assembly. In further examples, directional drilling tools may be disposed within the wellbore using wireline, electric line, or slick line. As will be appreciated by those of ordinary skill in the art, bottom hole assembly 130 may include directional drilling tools including but not limited to a measurement-while drilling (MWD) and/or logging-while drilling (LWD) system, magnetometers, accelerometers, agitators, bent subs, orienting subs, mud motors, rotary steerable systems (RSS), jars, vibration reduction tools, roller reamers, pad pushers, non-magnetic drilling collars, whipstocks, push-the-bit systems, point-the-bit systems, directional steering heads and other directional drilling tools. Directional drilling tools may be disposed anywhere along the drill string assembly including at the portion distal to the drilling right which may be known as the Bottom hole assembly 130 may comprise any number of tools, transmitters, and/or receivers to perform downhole measurement operations. In some scenarios, these downhole measurements produce drilling parameters which may be used to guide the drilling operation. For example, as illustrated in FIG. 1, bottom hole assembly 130 may include a measurement assembly 134. It should be noted that measurement assembly 134 may make up at least a part of bottom hole assembly 130. Without limitation, any number of different measurement assemblies, communication assemblies, battery assemblies, and/or the like may form bottom hole assembly 130 with measurement assembly 134. Additionally, measurement assembly 134 may form bottom hole assembly 130 itself. In examples, measurement assembly 134 may comprise at least one sensor 136, which may be disposed at the surface of measurement assembly 134. It should be noted that while FIG. 1 illustrates a single sensor 136, there may be any number of sensors disposed on or within measurement assembly 134. Without limitation, sensors may be referred to as a transceiver. Further, it should be noted that there may be any number of sensors disposed along bottom hole assembly 130 at any degree from each other. In examples, sensors 136 may also include backing materials and matching layers. It should be noted that sensors 136 and assemblies housing sensors 136 may be removable and replaceable, for example, in the event of damage or failure.

Without limitation, bottom hole assembly 130 may be connected to and/or controlled by information handling system 131, which may be disposed on surface 108. Without limitation, information handling system 131 may be disposed down hole in bottom hole assembly 130. Processing of information recorded may occur down hole and/or on surface 108. Processing occurring downhole may be transmitted to surface 108 to be recorded, observed, and/or further analyzed. Additionally, information recorded on information handling system 131 that may be disposed down hole may be stored until bottom hole assembly 130 may be brought to surface 108. In examples, information handling system 131 may communicate with bottom hole assembly 130 through a communication line (not illustrated) disposed in (or on) drill string 116. In examples, wireless communication may be used to transmit information back and forth between information handling system 131 and bottom hole assembly 130. Information handling system 131 may transmit information to bottom hole assembly 130 and may receive as well as process information recorded by bottom hole assembly 130. In examples, a downhole information handling system (not illustrated) may include, without limitation, a microprocessor or other suitable circuitry, for estimating, receiving, and processing signals from bottom hole assembly 130. Downhole information handling system (not illustrated) may further include additional components, such as memory, input/output devices, interfaces, and the like. In examples, while not illustrated, bottom hole assembly 130 may include one or more additional components, such as analog-to-digital converter, filter, and amplifier, among others, which may be used to process the measurements of bottom hole assembly 130 before they may be transmitted to surface 108. Alternatively, raw measurements from bottom hole assembly 130 may be transmitted to surface 108.

Any suitable technique may be used for transmitting signals from bottom hole assembly 130 to surface 108, including, but not limited to, wired pipe telemetry, mud-pulse telemetry, acoustic telemetry, and electromagnetic telemetry. While not illustrated, bottom hole assembly 130 may include a telemetry subassembly that may transmit telemetry data to surface 108. At surface 108, pressure sensors (not shown) may convert the pressure signal into electrical signals for a digitizer (not illustrated). The digitizer may supply a digital form of the telemetry signals to information handling system 131 via a communication link 140, which may be a wired or wireless link. The telemetry data may be analyzed and processed by information handling system 131.

As illustrated, communication link 140 (which may be wired or wireless, for example) may be provided that may transmit data from bottom hole assembly 130 to an information handling system 131 at surface 108. Information handling system 131 may include a personal computer 141, an output device 142 (e.g., a video display), an input device 144 (e.g., keyboard, mouse, etc.), and/or non-transitory computer-readable media 146 (e.g., optical disks, magnetic disks) that may store code representative of the methods described herein. In addition to, or in place of processing at surface 108, processing may occur downhole, at an offsite location, or any combination thereof. In some examples, and as described in further detail below, the processing of information handling system 131 may be performed using one or more computers which may further be located in one or more locations. In a non-limiting example, the processing of information handling system 131 may be performed using a network of computers. As discussed below, information handling system 131 may be utilized in the navigation of the steering equipment of drilling system 100 in accordance with a pre-planned wellbore trajectory or wellplan.

Information handling system 131 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 131 may be a personal computer, a network storage device, or any other suitable device and may vary in size, shape, performance, functionality, and price. Information handling system 131 may include random access memory (RAM), one or more processing resources such as a central processing unit 134 (CPU) or hardware or software control logic, ROM, and/or other types of nonvolatile memory. Additional components of the information handling system 131 may include one or more disk drives 146, output devices 142, such as a video display, and one or more network ports for communication with external devices as well as an input device 144 (e.g., keyboard, mouse, etc.). Information handling system 131 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Figure 2:
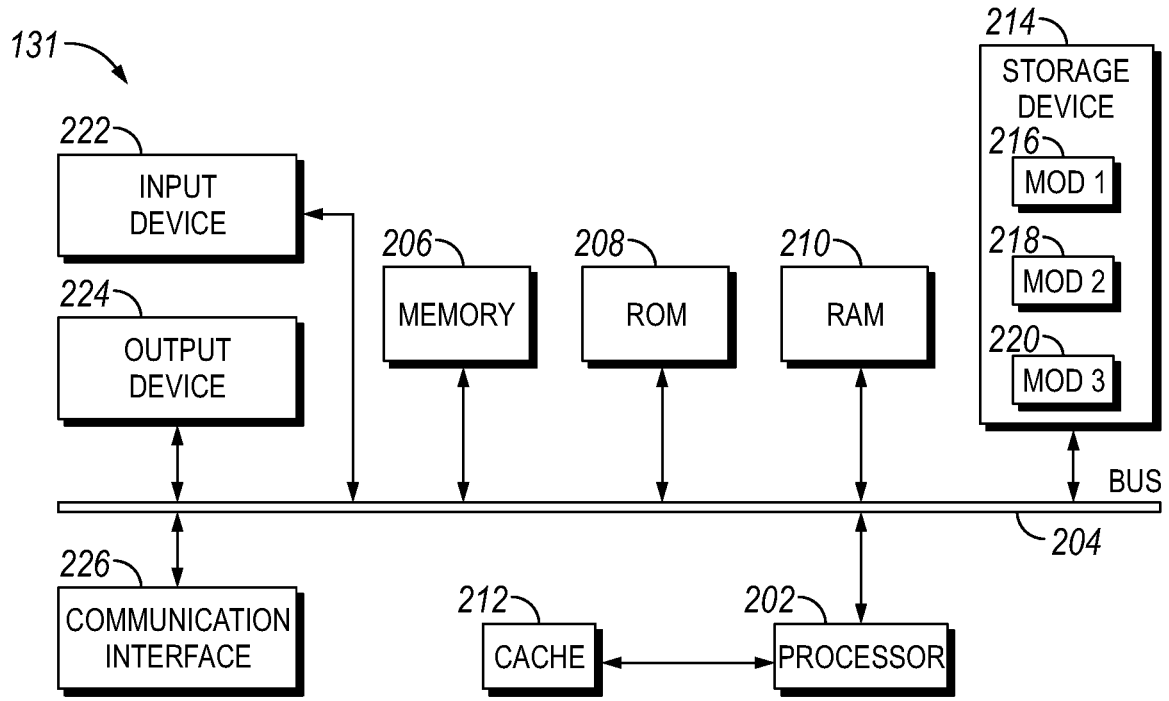
FIG. 2 illustrates is a schematic view of an information handling system.

FIG. 2 illustrates an example information handling system 131 which may be employed to perform various steps, methods, and techniques disclosed herein. Persons of ordinary skill in the art will readily appreciate that other system examples are possible. As illustrated, information handling system 131 includes a processing unit (CPU or processor) 202 and a system bus 204 that couples various system components including system memory 206 such as read only memory (ROM) 208 and random-access memory (RAM) 210 to processor 202. Processors disclosed herein may all be forms of this processor 202. Information handling system 131 may include a cache 212 of high-speed memory connected directly with, in close proximity to, or integrated as part of processor 202. Information handling system 131 copies data from memory 206 and/or storage device 214 to cache 212 for quick access by processor 202. In this way, cache 212 provides a performance boost that avoids processor 202 delays while waiting for data. These and other modules may control or be configured to control processor 202 to perform various operations or actions. Other system memory 206 may be available for use as well. Memory 206 may include multiple different types of memory with different performance characteristics. It may be appreciated that the disclosure may operate on information handling system 131 with more than one processor 202 or on a group or cluster of computing devices networked together to provide greater processing capability. Processor 202 may include any general-purpose processor and a hardware module or software module, such as first module 216, second module 218, and third module 220 stored in storage device 214, configured to control processor 202 as well as a special-purpose processor where software instructions are incorporated into processor 202. Processor 202 may be a self-contained computing system, containing multiple cores or processors, a bus, memory controller, cache, etc. A multi-core processor may be symmetric or asymmetric. Processor 202 may include multiple processors, such as a system having multiple, physically separate processors in different sockets, or a system having multiple processor cores on a single physical chip. Similarly, processor 202 may include multiple distributed processors located in multiple separate computing devices but working together such as via a communications network. Multiple processors or processor cores may share resources such as memory 206 or cache 212 or may operate using independent resources. Processor 202 may include one or more state machines, an application specific integrated circuit (ASIC), or a programmable gate array (PGA) including a field PGA (FPGA).

Each individual component discussed above may be coupled to system bus 204, which may connect each and every individual component to each other. System bus 204 may be any of several types of bus structures including a memory bus or memory controller, a peripheral bus, and a local bus using any of a variety of bus architectures. A basic input/output (BIOS) stored in ROM 208 or the like, may provide the basic routine that helps to transfer information between elements within information handling system 131, such as during start-up. Information handling system 131 further includes storage devices 214 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 214 may include software modules 216, 218, and 220 for controlling processor 202. Information handling system 131 may include other hardware or software modules. Storage device 214 is connected to the system bus 204 by a drive interface. The drives and the associated computer-readable storage devices provide nonvolatile storage of computer-readable instructions, data structures, program modules and other data for information handling system 131. In one aspect, a hardware module that performs a particular function includes the software component stored in a tangible computer-readable storage device in connection with the necessary hardware components, such as processor 202, system bus 204, and so forth, to carry out a particular function. In another aspect, the system may use a processor and computer-readable storage device to store instructions which, when executed by the processor, cause the processor to perform operations, a method or other specific actions. The basic components and appropriate variations may be modified depending on the type of device, such as whether information handling system 131 is a small, handheld computing device, a desktop computer, or a computer server. When processor 202 executes instructions to perform "operations", processor 202 may perform the operations directly and/or facilitate, direct, or cooperate with another device or component to perform the operations.

As illustrated, information handling system 131 employs storage device 214, which may be a hard disk or other types of computer-readable storage devices which may store data that are accessible by a computer, such as magnetic cassettes, flash memory cards, digital versatile disks (DVDs), cartridges, random access memories (RAMs) 210, read only memory (ROM) 208, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with information handling system 131, an input device 222 represents any number of input mechanisms, such as a microphone for speech, a touch-sensitive screen for gesture or graphical input, keyboard, mouse, motion input, speech and so forth. An output device 224 may also be one or more of a number of output mechanisms known to those of skill in the art. In some instances, multimodal systems enable a user to provide multiple types of input to communicate with information handling system 131. Communications interface 226 generally governs and manages the user input and system output. There is no restriction on operating on any particular hardware arrangement and therefore the basic hardware depicted may easily be substituted for improved hardware or firmware arrangements as they are developed.

As illustrated, each individual component describe above is depicted and disclosed as individual functional blocks. The functions these blocks represent may be provided through the use of either shared or dedicated hardware, including, but not limited to, hardware capable of executing software and hardware, such as a processor 202, that is purpose-built to operate as an equivalent to software executing on a general-purpose processor. For example, the functions of one or more processors presented in FIG. 2 may be provided by a single shared processor or multiple processors. (Use of the term "processor" should not be construed to refer exclusively to hardware capable of executing software.) Illustrative examples may include microprocessor and/or digital signal processor (DSP) hardware, read-only memory (ROM) 208 for storing software performing the operations described below, and random-access memory (RAM) 210 for storing results. Very large-scale integration (VLSI) hardware examples, as well as custom VLSI circuitry in combination with a general-purpose DSP circuit, may also be provided.

Figure 3:
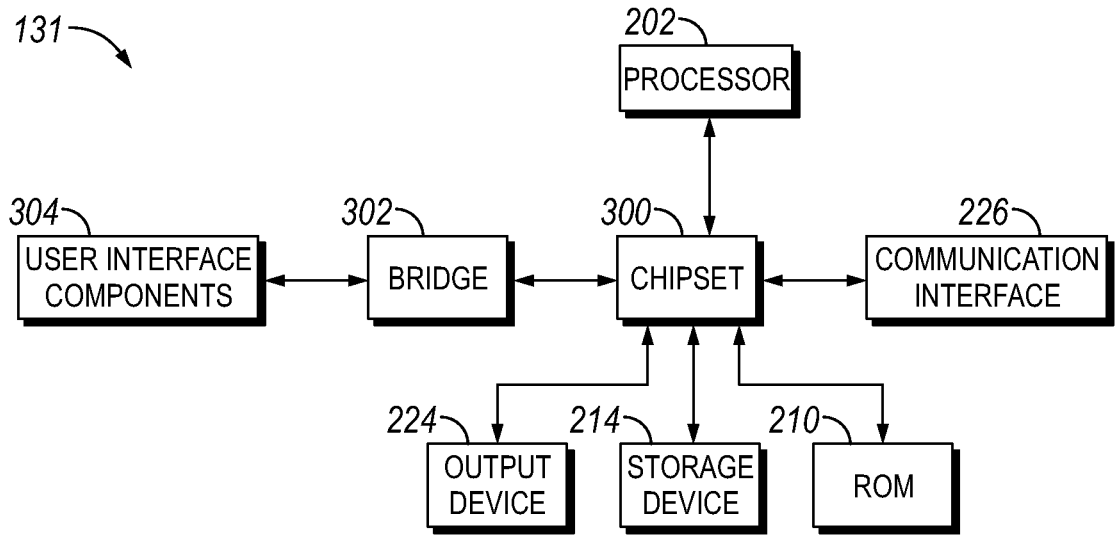
FIG. 3 illustrates another schematic view of and information handling system.

FIG. 3 illustrates an example information handling system 131 having a chipset architecture that may be used in executing the described method and generating and displaying a graphical user interface (GUI). Information handling system 131 is an example of computer hardware, software, and firmware that may be used to implement the disclosed technology. Information handling system 131 may include a processor 202, representative of any number of physically and/or logically distinct resources capable of executing software, firmware, and hardware configured to perform identified computations. Processor 202 may communicate with a chipset 300 that may control input to and output from processor 202. In this example, chipset 300 outputs information to output device 224, such as a display, and may read and write information to storage device 214, which may include, for example, magnetic media, and solid-state media. Chipset 300 may also read data from and write data to RAM 210. A bridge 302 for interfacing with a variety of user interface components 304 may be provided for interfacing with chipset 300. Such user interface components 304 may include a keyboard, a microphone, touch detection and processing circuitry, a pointing device, such as a mouse, and so on. In general, inputs to information handling system 131 may come from any of a variety of sources, machine generated and/or human generated.

Chipset 300 may also interface with one or more communication interfaces 226 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 202 analyzing data stored in storage device 214 or RAM 210. Further, information handling system 131 receive inputs from a user via user interface components 304 and execute appropriate functions, such as browsing functions by interpreting these inputs using processor 202.

In examples, information handling system 131 may also include tangible and/or non-transitory computer-readable storage devices for carrying or having computer-executable instructions or data structures stored thereon. Such tangible computer-readable storage devices may be any available device that may be accessed by a general purpose or special purpose computer, including the functional design of any special purpose processor as described above. By way of example, and not limitation, such tangible computer-readable devices may include RAM, ROM, EEPROM, CD-ROM or other optical disk storage, magnetic disk storage or other magnetic storage devices, or any other device which may be used to carry or store desired program code in the form of computer-executable instructions, data structures, or processor chip design. When information or instructions are provided via a network, or another communications connection (either hardwired, wireless, or combination thereof), to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general-purpose computer, special purpose computer, or special purpose processing device to perform a certain function or group of functions. Computer-executable instructions also include program modules that are executed by computers in standalone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

During drilling operations, information handling system 131 may process different types of the real-time data originated from varied sampling rates and various sources, such as diagnostics data, sensor measurements, operations data, and/or the like. These measurements from wellbore 102, BHA 130, measurement assembly 134, and sensor 136 may allow for information handling system 131 to perform real-time health assessment of the drilling operation. Drilling tools and equipment may further comprise a variety of sensors which may be able to provide real-time measurements and data relevant to steering the drilling equipment in order to construct a wellbore in adherence to a well plan. In some examples this drilling equipment may include drilling rigs, top drives, drilling tubulars, mud motors, gyroscopes, accelerometers, magnetometers, bent housing subs, directional steering heads, rotary steerable systems ("RSS"), whipstocks, push-the-bit systems, point-the-bit systems, and other directional drilling tools. In the context of drilling operations, "real-time," may be construed as monitoring, gathering, assessing, and/or utilizing data contemporaneously with the execution of the drilling operation. In further examples, real-time may be understood to relate to a system, apparatus, or method in which a set of input data is processed and available for use when new survey information is acquired. For example, once the new survey information is acquired the data may be processed and available for use within 100 milliseconds ("ms") to 1 second. Real-time operations may further comprise modifying the initial design or execution of the planned operation in order to modify the trajectory of a drilling operation. In some examples, the modifications to the drilling operation may occur through automated or semi-automated processes. In further examples, an automated drilling process may include conducting or performing one or more portions of a drilling operation without the use of human intervention. In some examples, the usage of algorithms may replace the requirement for human intervention in the decision-making process. In other examples, the section of a wellbore that a drill bit (e.g., drill bit 122 in FIG. 1) is located in may be identified according to a section detection algorithm without the requirement for human intervention. In further examples, the section detection algorithm may be partially or fully automated. Additionally, a control algorithm may be used to identify operational parameters which may be used to construct a wellbore according to a wellplan. In some examples, the control algorithm may be partially or fully automated such that the operational parameters may be at least partially determined without human intervention. For example, an automated drilling process may include relaying or downlinking a set of operational commands (control commands) to an RSS in order to modify a drilling operation to achieve a certain objective. In other examples, operational commands (control commands) may be automatically relayed to the top drive. In other examples, the operational commands (control commands) may be relayed to the rig personnel for review prior to implementation. In some examples, drilling objectives may be incorporated into the drilling operation through minimization of a cost function, which will be discussed in further detail below.

Figure 4:
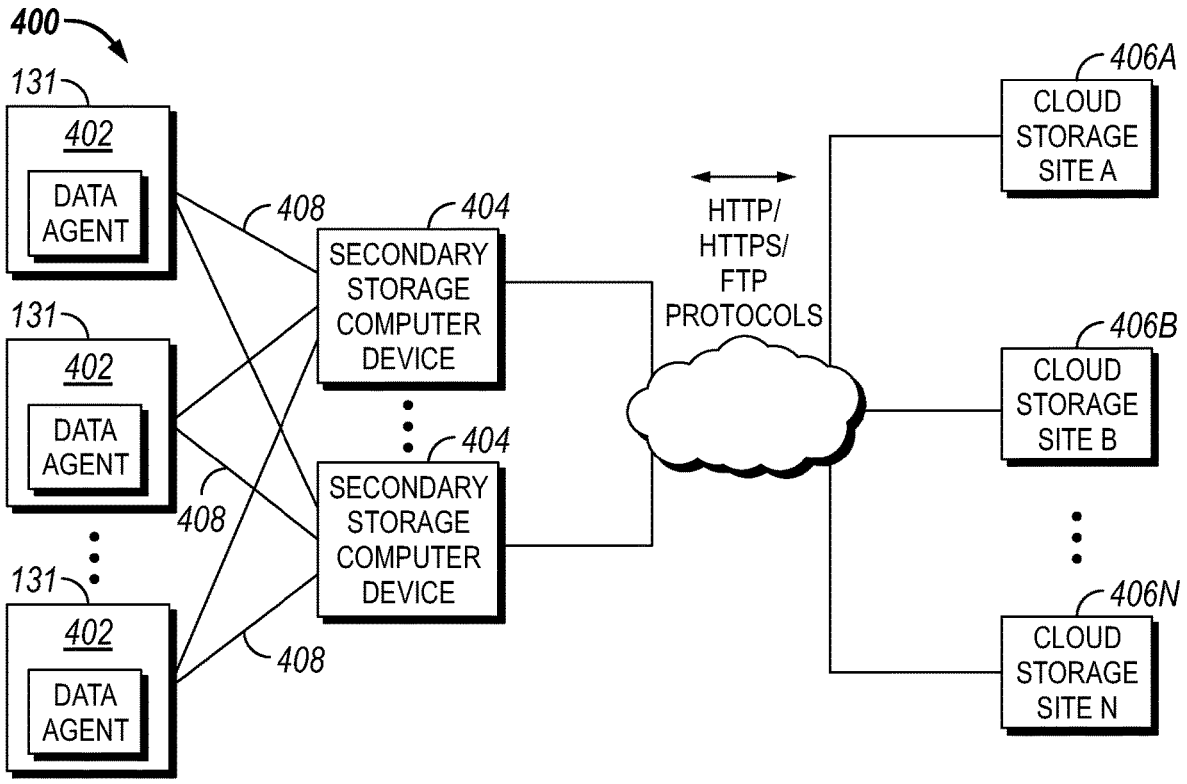
FIG. 4 illustrates a schematic view of a network.

FIG. 4 illustrates an example of one arrangement of resources in a computing network 400 that may employ the processes and techniques described herein, although many others are of course possible. As noted above, an information handling system 131, as part of their function, may utilize data, which includes files, directories, metadata (e.g., access control list (ACLS) creation/edit dates associated with the data, etc.), and other data objects. The data on the information handling system 131 is typically a primary copy (e.g., a production copy). During a copy, backup, archive or other storage operation, information handling system 131 may send a copy of some data objects (or some components thereof) to a secondary storage computing device 404 by utilizing one or more data agents 402.

A data agent 402 may be a desktop application, website application, or any software-based application that is run on information handling system 131. As illustrated, information handling system 131 may be disposed at any rig site (e.g., referring to FIG. 1) or repair and manufacturing center. The data agent may communicate with a secondary storage computing device 404 using communication protocol 408 in a wired or wireless system. The communication protocol 408 may function and operate as an input to a website application. In the website application, field data related to pre- and post-operations, generated DTCs, notes, and the like may be uploaded. Additionally, information handling system 131 may utilize communication protocol 408 to access processed measurements, operations with similar DTCs, troubleshooting findings, historical run data, and/or the like. This information is accessed from secondary storage computing device 404 by data agent 402, which is loaded on information handling system 131.

Secondary storage computing device 404 may operate and function to create secondary copies of primary data objects (or some components thereof) in various cloud storage sites 406A-N. Additionally, secondary storage computing device 404 may run determinative algorithms, such as the section detection algorithm or the control algorithm, on data uploaded from one or more information handling systems 131, discussed further below. Communications between the secondary storage computing devices 404 and cloud storage sites 406A-N may utilize REST protocols (Representational state transfer interfaces) that satisfy basic C/R/U/D semantics (Create/Read/Update/Delete semantics), or other hypertext transfer protocol ("HTTP")-based or file-transfer protocol ("FTP")-based protocols (e.g., Simple Object Access Protocol).

In conjunction with creating secondary copies in cloud storage sites 406A-N, the secondary storage computing device 404 may also perform local content indexing and/or local object-level, sub-object-level or block-level deduplication when performing storage operations involving various cloud storage sites 406A-N. Cloud storage sites 406A-N may further record and maintain DTC code logs for each downhole operation or run, map DTC codes, store repair and maintenance data, store operational data, and/or provide outputs from determinative algorithms that are located in cloud storage sites 406A-N. In a non-limiting example, this type of network may be utilized as a platform to store, backup, analyze, import, and preform extract, transform and load ("ETL") processes to the data gathered during a drilling operation.

Figure 5:
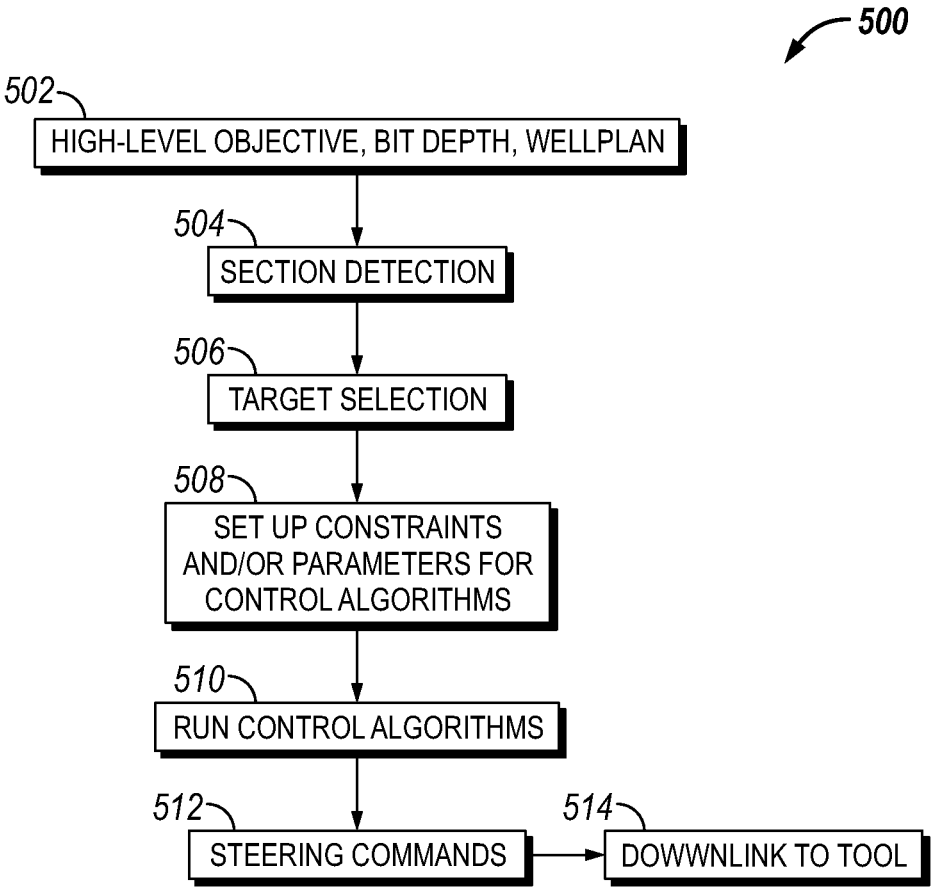
FIG. 5 illustrates a workflow for autonomous vertical-curve-lateral (VCL) drilling.

FIG. 5 illustrates workflow 500 for autonomous vertical-curve-lateral ("VCL") drilling. Workflow 500 may be performed utilizing one or more information handling systems 131 in a computing network 400 (i.e., referring to FIG. 5). Workflow 500 may be used to divide a wellplan into vertical, tangent, curve, and lateral sections based at least in part on predetermined criteria. The inputs to workflow 500, such as the reference wellplan, bit depth, and high-level objective may be identified in block 502. In some examples, the bit depth may be determined from a depth measurement. In further examples, the depth measurement may be determined from the cumulative length of the drill pipe and drilling tools disposed within the well. In some examples, the depth may additionally be determined by incorporating inputs such as the string weight and block height or top drive height. In further examples, the string weight may be determined from the hook load, which may further be determined from the hook load sensors. In some examples, the reference wellplan (e.g., "wellplan") may include associated pairs of intended (e.g., planned) dog-leg severity ("DLS") and inclination values which may vary according to vertical depth. In further examples, the predetermined criteria may include grouping the ranges for the associated pairs of intended (e.g., planned) DLS and inclination values and labelling the groupings with a categorical descriptor. The categorical descriptor may be associated with a section of a wellbore. In some examples, a "high level objective," may be a function of the categorical descriptor or the objectives in a given section of the wellbore. For example, each section of a wellplan may be categorized as one of a vertical, tangent, curve, and/or lateral section according to the aforementioned, pre-defined ranges for DLS and inclination. These categories may further tie to the high-level objective as identified in block 502. In some examples, the boundaries utilized to group the ranges, which define a particular section, may vary from well to well. The boundaries utilized to group the ranges and delineate the categories for the wellbore sections (e.g., the current section if drill bit 122 is located in a defined wellbore section) may be furthered described as depicted in FIG. 6.

Figure 6:
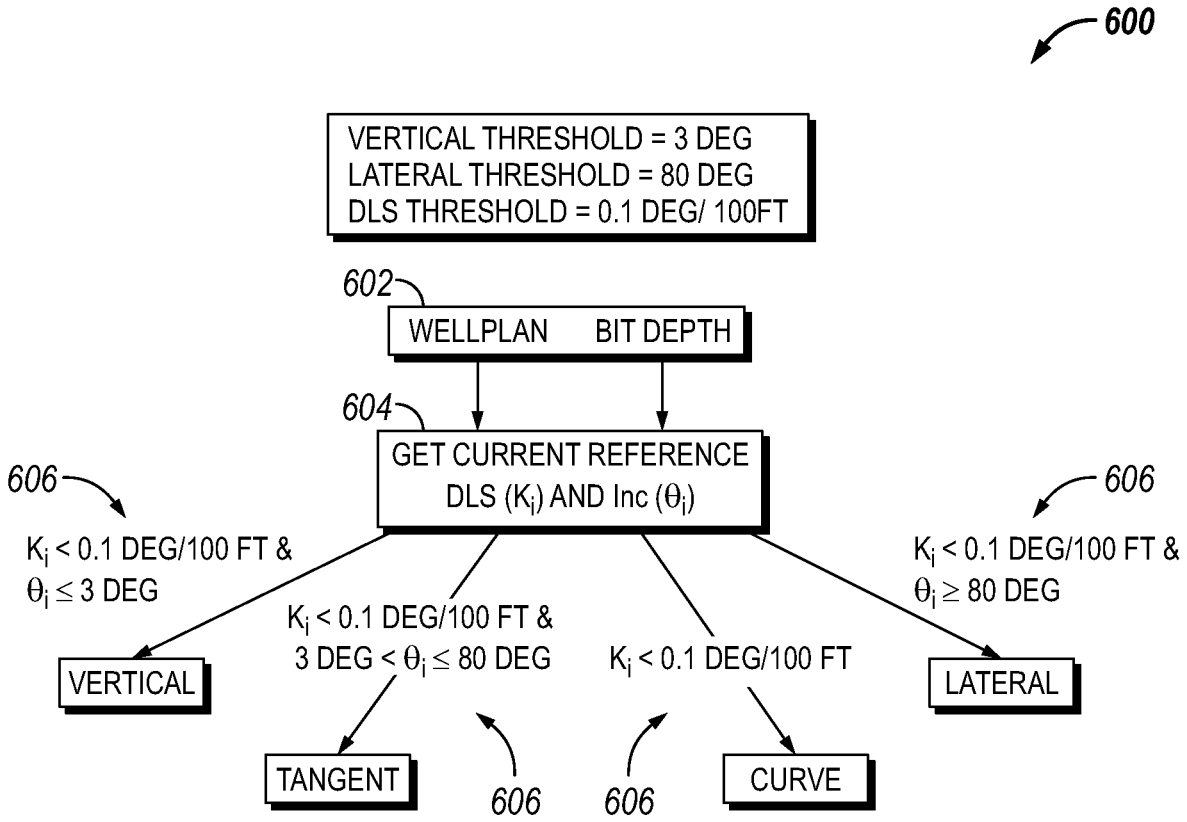
FIG. 6 illustrates how a section of a wellplan is detected.

FIG. 6 illustrates how a section detected in block 504 of FIG. 5 may be determined using workflow 600. Workflow 600 may begin with block 602 where inputs such as the wellplan and the bit depth are identified or specified. The inputs may be the wellplan from block 502 in FIG. 5 and the current depth of drill bit 122 (e.g., referring to FIG. 1). Using the inputs from block 602, a DLS and an inclination angle may be identified in block 604. For example, the wellplan may include tabular data columns for DLS values and associated inclination values as a function of depth such that any given depth, a DLS and inclination value may be identified or interpolated. The identification of the dog leg severity and the inclination angle in block 604 may be compared to a pre-determined criteria in block 606 to identify whether the current bit depth is associated with a vertical section, a tangent section, a curve section, and/or a lateral section in comparison to the wellplan. For the given example, the vertical threshold may be 3 degrees, the lateral threshold may be 80 degrees, and the dog-leg severity threshold ("DLS threshold") may be 0.1 degrees per 100 feet (0.1 degrees per 30.5 meters). While the foregoing thresholds may provide for example thresholds which may be applied to a given well, the threshold values should not be construed as to limit the possible threshold values to the values provided in this specific example. As such, alternative thresholds may be utilized. For example, the value selected for the vertical threshold may be value between about 0 and about 3 degrees, the value selected for the lateral threshold may be a value between about 80 and about 95 degrees, and the value selected for the dog-leg severity threshold ("DLS threshold") may be a value between about 0 degrees per 100 feet and about 0.5 degrees per 100 ft (0.5 degrees per 30.5 meters). As previously described, various ranges for DLS and inclination may be grouped or categorized in accordance with a wellbore section as depicted in block 606. The categorized wellbore sections in block 606 may be an output in block 504 of workflow 500 (e.g., referring to FIG. 5) The wellbore section detection algorithm as depicted in FIG. 6 and described in the foregoing may be executed utilizing one or more information handling systems (e.g., information handling system 131 in FIG. 1) in a computing network (e.g., computing network 400 in FIG. 4). In some examples, section detection may be determined utilizing position-based criteria in lieu of DLS and inclination as described in the forgoing. For example, sections may be identified by comparing the true vertical depth ("TVD") of the drill bit 122 (e.g., referring to FIG. 1) with the predetermined wellplan where various TVD ranges are associated with different wellbore sections. In some examples, the section detection algorithm may be run separately for inclination and azimuth which may allow for build sections to be determined independently of turn sections. In such examples, changes in inclination may affect the build rate which may further be associated with a build section. Likewise, changes in azimuth may affect the turn rate which may be further associated with a turn section.

In block 504, the section detection algorithm may be utilized to detect the current section based on the inputs of block 502. In some examples, this may be referred to as a section detection algorithm. In further examples, the section detection algorithm may be utilized to detect the current section in real-time during drilling operations. The current section may refer to the section in which the drill bit 122 (e.g., referring to FIG. 1) may be located. In some examples, a target may be selected in block 506 according to the identified section from block 504. In some examples, the selected target may be a physical location in 3-dimensional space to which drill bit 122 (e.g., referring to FIG. 1) is intended to progress. For example, the end point location of a current section as detailed in a wellplan may be used as a target. In other examples, the target may be a location along a trajectory as detailed in a wellplan which falls within the current section. In additional examples, the target may be a location along a trajectory as detailed in a wellplan which is located in a subsequent section. The target may include a location, attitude, build rate, walk rate, curvature, or combinations thereof. In some examples, the target selected in block 506 may be a specified azimuth, inclination, or attitude which may further be selected in accordance with a geosteering objective. In some examples, a drilling objective may be selected in block 506 according to the identified section from block 504. Utilizing drilling objectives may increase the performance of a system. For example, a drilling objective may be formulated to minimize tortuosity, borehole length, downlink commands, time spent drilling, final offset from the target, vibrations, and maximize ROP, and combinations thereof. Once a target is selected in block 506, the constraints and/or operational parameters for the control algorithm may be established in block 508 such that they meet the objective identified in block 506. For example, the constraints and/or operational parameters of block 508 may be used to direct and/or steer bottom hole assembly 130 (e.g., referring to FIG. 1) towards the target identified in block 506. In other examples, the operational parameters of block 508 may be used to formulate a control problem which describes objectives and/or dynamics according to functions of state and control variables. In further examples, constraints may be the lower and upper bounds on the state and control variables. The constraints may be used to establish the boundaries for the problem, however, once a solution for the problem is determined, the optimal state and control variables are obtained. The identified optimal state and control variables may thereafter be utilized to steer bottom hole assembly 130 (e.g., referring to FIG. 1) or drill bit 122 (e.g., referring to FIG. 1).

Control algorithms for automated drilling may utilize specified parameters to achieve desired performance. In some examples, control algorithms may be used interchangeably with control methods. In some examples, automated drilling may include the determination of operational parameters where at least a portion of the process is performed on information handling system 131 (e.g., referring to FIG. 1) without the intervention of a human. In some examples, model-free control algorithms such as proportional-integral-derivative ("PID") control algorithms may require gain tables which vary according to the required level of aggressiveness. In some examples, suitable control algorithms may include model-based controls, such as, but not limited to, linear-quadratic regulator (LQR), model predictive controller (MPC), linear-quadratic-Gaussian (LQG) control, adaptive control, sliding mode control, min-max control, and model-free control algorithms, such as, but not limited to proportional-integral-derivative (PID), fuzzy control, and combinations thereof. In some examples the required level of aggressiveness may vary according to the detected section and the specific scenario. For example, sections of a well that are intended to be relatively straight, and which may not include large changes in inclination or azimuth may utilize less aggressive gain tables. For sections which include more curvature, the control aggressiveness may depend on whether the drilling operation is ahead or behind the wellplan. For example, in some situations the bottom hole assembly of a drill string may not generate adequate build rates or curvature relative to the required wellplan. In such a case, the well that is generated may be considered to be "behind," relative to the expectations as set forth in the wellplan. In such examples, the wellbore may not build curvature as quickly as required by the wellplan and more aggressive gain tables may be utilized. In other examples, sections of the well which may include large changes or variations in inclination or azimuth may have less aggressive gain tables if the wellbore is adequately achieving the required curvature build with respect to the wellplan. Additional control algorithms may utilize model-based methods, such as a linear-quadratic regulators ("LQR"), model predictive control (MPC), adaptive control, sliding control, minimum/maximum control, and combinations thereof. LQR may be a form of a feedback regulator where a dynamic system is operated at a minimum cost. LQR and MPC may be similar control methodologies, for example, utilizing LQR repeatedly with a receding horizon may be a form of MPC. Additionally, while MPC may use constraints, as discussed below, LQR does not utilize constraints. In some examples, MPC may utilize an objective-based cost function in conjunction with constraints for the system states. In some examples, the objective which, helps define the cost function and the constraints, may be a function of attitude (e.g., azimuth and inclination), curvature, and/or position. In some examples, the selection of the parameters for a given section may be automated. In further examples, the automated selection of parameters for a given section may be performed on information handling system 131 (e.g., referring to FIG. 1) and may not require human intervention to perform parameter selection. As such, a human user may not be required to provide or otherwise input the parameters to continue drilling through a given section or to continue drilling while transitioning from one section to another. Rather, information handling system 131 (e.g., referring to FIG. 1) may be used to determine the drilling commands and parameters used to drill through a given section or to drill through transitions from one section to another.

An example of using optimization-based control in adherence with the foregoing description may be defined in the form as detailed below. For a given control problem, the functions of f(x), gi(x), and hi(x) may need to be well defined.

$$\begin{aligned} &\min \ f(x) \\ &\text{subject to } \ g_i(x) = c_i \text{ for } i = 1, \ldots, n \\ &\qquad\qquad\ \ h_j(x) \geq d_j \text{ for } j = 1, \ldots, m \end{aligned} \tag{1}$$

where x is the problem variable which may comprise of attitude (i.e., inclination and azimuth), curvature, position, and/or control command (toolface and steering ratio). Additionally, f(x) is the objective function of the problem, which is formulized such that the minimization of this value would result in the optimal performance of the system. The objective function may be based on tortuosity, borehole length, limited change in downlink commands, time spent drilling, final offset from target, or a weighted combination thereof. The variable $g_i(x)$ may represent the equality constraints and it may be used to describe system model and/or waypoint or target constraints in terms of attitude, curvature and/or position where n is the number of equality constraints. Further, the variable $h_i(x)$ may represent the inequality constraints where m is the number of inequality constraints. Inequality constraints may be used to put upper and lower bounds on the attitude, curvature, tortuosity, and/or position.

For the wellplan, different objectives and constraints for the vertical section, curve section, and lateral sections (e.g., referring to block 606) may be represented by different formulations of f, g, and h. The proposed method proposes to formulate these functions and solve the corresponding optimization problem best suitable for the given section, given as follows:

$$\begin{aligned} &\text{Section } (1\text{:vertical, } 2\text{:tangent, } 3\text{:curve, } 4\text{:lateral}) \\ &\text{Scenario } (1\text{:ahead of wellplan, } 2\text{:behind the wellplan}) \\ &\qquad K = 1, \ldots, 4 \\ &\qquad l = 1, 2 \\ &\qquad \text{if section} = k \text{ and scenario} = 1 \\ &\qquad\qquad f = f^{kl} \\ &\qquad\qquad g_i = g_i^{jkl} \\ &\qquad\qquad h_j = h_j^{kl} \end{aligned} \tag{2}$$

-continued

Solve *Prob* 1 to get steering recommendations

In some examples, the foregoing optimization problem may be used in accordance with a variety of combinations of scenarios and objectives. For example, some scenarios may include solving the optimization problem when the actual well trajectory is ahead of or behind the wellplan with respect to the achieved attitude or well position. In further examples, the drilling equipment and/or bottom hole assembly 130 (e.g., referring to FIG. 1) may not achieve sufficient tool yield such that the actual well trajectory is behind the wellplan. In further examples, the tool yield may be tied to the build rate or the turn rate, and each of build rate and turn rate may be solved for separately. Build rate and turn rate will be further described below. While any of the foregoing may be solved for separately, they may additional be solved for in any combination.

Referring back to FIG. 5, as noted above, the control algorithm then sets the control parameters for the current section and/or transition point in block 508. In some examples, the control algorithm may automatically set the next target and adjust the control constraints on position, attitude, build rate, walk rate, curvature, or combinations thereof. Given the target and objective, and the constraints, the suitable control algorithm is selected and run to provide steering recommendations. In block 510, the control algorithm may be run on information handling system 131, which may produce steering commands in block 512, which may be transmitted to bottom hole assembly 130 in block 514. As each target is hit, workflow 500 may be performed continuously.

The FIGS. 7A-7D may depict some of the features of blocks 508-512 (e.g., referring to FIG. 5) of workflow 500. For example, in block 508, inequality constraints such as an upper and/or a lower bound may be identified. The output of block 508 (e.g., referring to FIG. 5) may be used to determine steering commands in block 510 which may either modify or maintain the trajectory of the well in order to intersect an intended target. In some examples the steering commands may be determined in order to achieve a specific build rate ("BR"), walk rate ("WR"), or attitude. As further described below, FIGS. 7A-7D are graphs that may depict how inequality constraints, such as upper and lower bound constraints, are used to bound a reference value, prospective result, or wellplan value. For example, when the drilled well is behind the wellplan, the boundaries may be larger which may allow for more aggressive control. In general, the requirement for more aggressive control may be associated with the utilization of larger boundaries. Likewise, the requirement for less aggressive controls may be associated with the utilization of more narrow boundaries. In some examples, the required level of control may be determined separately for the azimuth and the inclination. In other examples, the level of control for the azimuth and the inclination may be weighted in the cost function to achieve different objectives. For example, increasing the weighting of azimuthal control may provide more azimuthal control while decreasing the weighting of azimuthal control may provide less azimuthal control. In further examples the required level of control for the azimuth may create boundaries for the walk rate ("WR") while the required level of control for the inclination may create boundaries for the build rate ("BR"). The level of aggressiveness in the controls may be associated with whether the drilled well path is ahead of or behind the wellplan. For example, the requirement for more aggressive control may be associated with scenarios where the drilled well path is behind the wellplan. Alternatively, the requirement for less aggressive control may be associated with scenarios where the drilled well path is on target with, or ahead of the wellplan. In some examples, it may be empirically identified that bottom hole assembly 130 (e.g., referring to FIG. 1) may not be able to achieve the build rates required by the wellplan in a curved section. As such larger boundaries may be utilized to get the well path aligned with the wellplan. In other examples, the wellbore may deviate from the intended wellpath, or fall behind the wellplan in the vertical, tangent, or lateral sections which may require more aggressive control and larger boundaries. In some examples, utilizing less aggressive controls by providing more narrow boundaries may result in a smoother wellbore trajectory with less aggressive curvature.

Figure 7A:
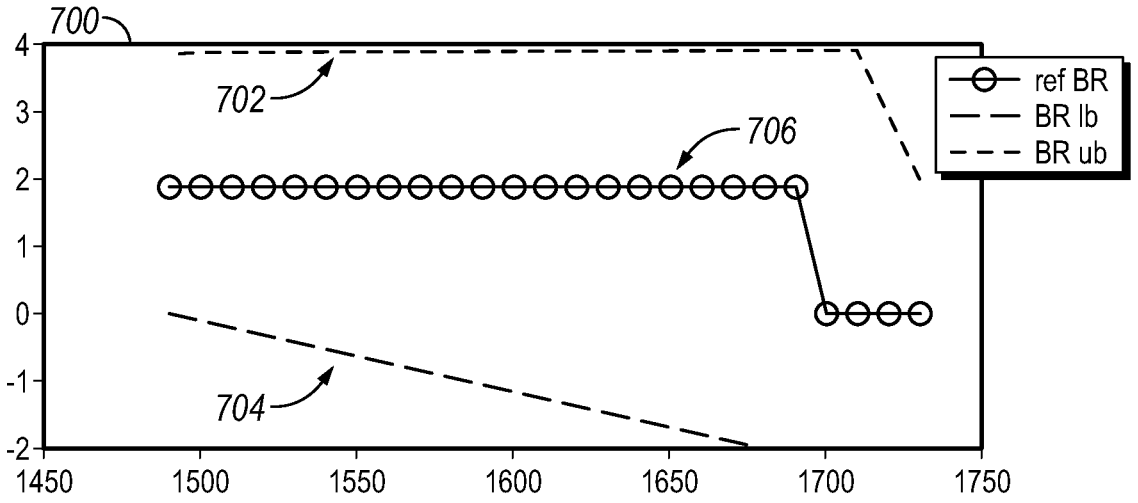
FIGS. 7A-7D are graphs which depict utilizing an upper and lower bound to constrain a wellplan value.
Figure 7B:
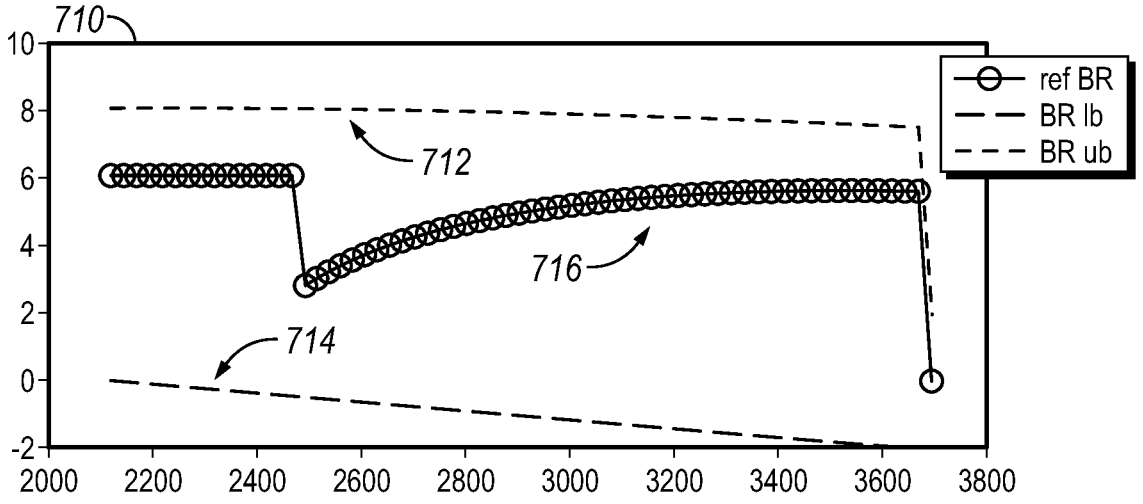
Figure 7C:
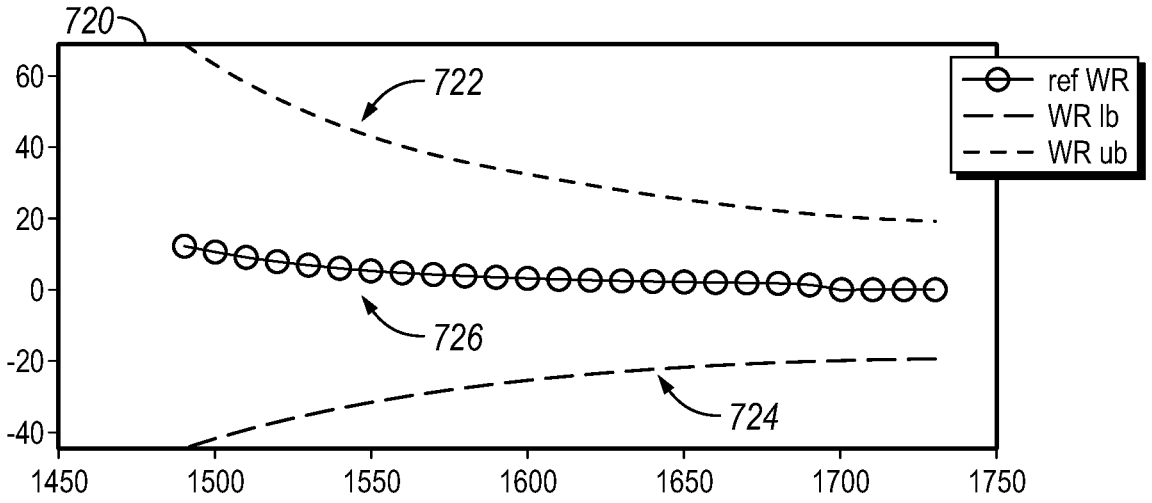
Figure 7D:
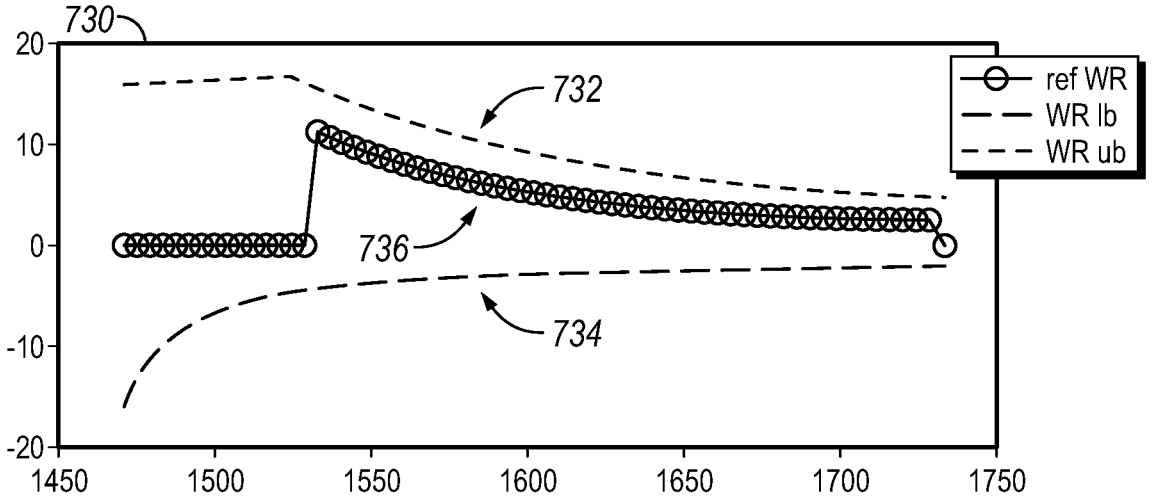

FIG. 7A and FIG. 7B may both depict boundaries utilized for the build rate of a wellbore section. FIG. 7A may comprise a graph 700 which further depicts an upper bound for build rate 702, a lower bound for build rate 704, and a wellplan build rate 706. FIG. 7B may comprise a graph 710, which further depicts an upper bound for build rate 712, a lower bound for build rate 714, and a wellplan build rate 716. As depicted, the wellbore section may be a curved section, however in practice it could be any section. The build rate ranges for FIG. 7A may depict a narrower range of build rates than what is depicted in FIG. 7B. For example, the difference between the upper bound for build rate 702 and the lower bound for build rate 704 in graph 700 may be less than the difference between the upper bound for build rate 712 and the lower bound for build rate 714 in graph 710. As such, graph 710 of FIG. 7B may have a more aggressive control requirement than graph 700 of FIG. 7A. FIG. 7C and FIG. 7D may both depict boundaries utilized for the walk rate of a wellbore section. FIG. 7C may comprise a graph 720 which further depicts an upper bound for walk rate 722, a lower bound for walk rate 724, and a wellplan walk rate 726. FIG. 7B may comprise a graph 730, which further depicts an upper bound for walk rate 732, a lower bound for walk rate 734, and a wellplan walk rate 736. The walk rate ranges for FIG. 7C may depict a broader range of walk rates than what is depicted in FIG. 7D. For example, the difference between the upper bound for build rate 722 and the lower bound for build rate 724 in graph 720 may be greater than the difference between the upper bound for build rate 732 and the lower bound for build rate 734 in graph 730. As such, FIG. 7D may have a less aggressive control requirement than FIG. 7C.

The proposed methods and systems are an improvement over prior technology in that the methods and systems described above provide automated detection of vertical section, tangent section, curved sections, or lateral sections of a wellbore in real-time. Additionally, methods are improvements over the current technology in that the methods use an information handling system rather than human intervention or input to determine and adjust parameters and objectives based on the current section. The information handling system may be further used to determine and adjust the parameters and objectives when transitioning between sections without requiring manual or human input. In current implementations, human intervention is required to select targets, objectives, and/or control algorithms and methodologies. For example, human intervention may be required when the drill bit and/or bottom hole assembly are transitioning from one section to another section. Automating these processes may allow for consistency in the drilling process among different wells.

The systems and methods may include any of the various features disclosed herein, including one or more of the following statements. The systems and methods may include any of the various features disclosed herein, including one or more of the following statements.

Statement 1: A method may comprise dividing a wellplan into one or more sections using a section detection algorithm, receiving a depth measurement of a drill bit or a bottom hole assembly located in a wellbore, utilizing the section detection algorithm and the depth measurement to identify a section of the wellplan from the one or more sections of the wellplan, and identifying a target based at least in part on the identified section. The method may further comprise determining one or more steering commands based at least in part on the target and a control algorithm and steering the bottom hole assembly to the target using the one or more steering commands.

Statement 2: The method of statement 1, further comprising identifying one or more constraints based at least in part on the identified section and determining the one or more steering commands based at least in part on the one or more constraints.

Statement 3: The method of any of the preceding statements, wherein the target is located within a same section of the wellplan from where the drill bit or the bottom hole assembly is located.

Statement 4: The method of any of the preceding statements, wherein the target is located within a different section of the wellplan from where the drill bit or the bottom hole assembly is located.

Statement 5: The method of any of the preceding statements, wherein identifying the section of the wellplan further comprises identifying at least one section selected from the group consisting of a vertical section, a tangent section, a curve section, and a lateral section.

Statement 6: The method of any of the preceding statements, wherein dividing the wellplan into one or more sections further comprises dividing the wellplan according to a vertical threshold, a lateral threshold, and a dog-leg severity threshold.

Statement 7: The method of statement 6, wherein the vertical threshold is about 0 degrees to about 3 degrees, the lateral threshold is about 80 degrees to about 95 degrees, and the dog-leg severity threshold is about 0 degrees per 100 feet to about 0.5 degrees per 100 feet.

Statement 8: The method of any of the preceding statements, wherein the target comprises at least one target selected from the group consisting of a location, an attitude, a curvature, a build rate, a walk rate, or a combination thereof.

Statement 9: The method of any of the preceding statements, wherein the control algorithm further comprises a model-based control or a model-free control.

Statement 10: The method of statement 9, wherein the model-based control comprises at least one model-based control selected from the group consisting of linear quadratic regulators, model predictive control, and combinations thereof.

Statement 11: The method of statement 9, wherein the model-free control is a proportional-integral-derivative.

Statement 12: A system may comprise a bottom hole assembly comprising at least one sensor configured to take at least one measurement and an information handling system. The information handling system may be configured to divide a wellplan into one or more sections based at least in part on a section detection algorithm and one or more thresholds, receive a depth measurement, wherein the depth measurement corresponds to a location of a drill bit or a bottom hole assembly, and utilize the section detection algorithm and the depth measurement to identify a section of the wellplan from the one or more sections of the wellplan. The information handling system may further be configured to identify a target based at least in part on the identified section of the wellplan, determine one or more steering commands based at least in part on the target and a control algorithm, and relay the one or more steering commands to the bottom hole assembly.

Statement 13: The system of statement 12, wherein the information handling system is further configured to identify one or more constraints based at least in part on the identified section and determine the one or more steering commands based at least in part on the one or more constraints.

Statement 14: The system of any of the preceding statements, 12-13, wherein the one or more sections of the wellplan include at least one section selected from the group consisting of a vertical section, a tangent section, a curve section, and a lateral section.

Statement 15: The system of any of the preceding statements, 12-14, wherein the one or more thresholds include at least one of a vertical threshold, a lateral threshold, and a dog-leg severity threshold, and wherein the vertical threshold is about 0 to about 3 degrees, the lateral threshold is about 80 degrees to about 95 degrees, and the dog-leg severity threshold is about 0 degrees per 100 feet to about 0.5 degrees per 100 feet.

Statement 16: The system of any of the preceding statements, 12-15, wherein the target comprises at least one target selected from the group consisting of a location, an attitude, a curvature, a build rate, a walk rate, or a combination thereof.

Statement 17: The system of any of the preceding statements, 12-16, wherein the control algorithm further comprises a model-based control algorithm.

Statement 18: The system of statement 17, wherein the model-based control algorithm comprises at least one model-based control algorithm selected from the group consisting of linear quadratic regulators, model predictive control, and combinations thereof.

Statement 19: The system of any of the preceding statements, 12-18, wherein the control algorithm is a model-free control algorithm.

Statement 20: The system of any of the preceding statements, 12-19, wherein the model-free control is a proportional-integral-derivative.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

dividing a wellplan into one or more sections using a section detection algorithm in real-time during drilling operations;

receiving a depth measurement of a drill bit or a bottom hole assembly located in a wellbore;

determining a current section of the wellplan with the section detection algorithm based on a depth measurement as a vertical section, a tangent section, a curve section, and a lateral section;

identifying a target based at least in part on the current section;

determining one or more steering commands based at least in part on the target and a control algorithm; and steering the bottom hole assembly to the target using the one or more steering commands.

2. The method of claim 1, further comprising identifying one or more constraints based at least in part on the current section and determining the one or more steering commands based at least in part on the one or more constraints.

3. The method of claim 1, wherein the target is located within a same section of the wellplan from where the drill bit or the bottom hole assembly is located.

4. The method of claim 1, wherein the target is located within a different section of the wellplan from where the drill bit or the bottom hole assembly is located.

5. The method of claim 1, wherein dividing the wellplan into one or more sections further comprises dividing the wellplan according to a vertical threshold, a lateral threshold, and a dog-leg severity threshold.

6. The method of claim 5 wherein the vertical threshold is about 0 degrees to about 3 degrees, the lateral threshold is about 80 degrees to about 95 degrees, and the dog-leg severity threshold is about 0 degrees per 100 feet to about 0.5 degrees per 100 feet.

7. The method of claim 1, wherein the target comprises at least one target selected from the group consisting of a location, an attitude, a curvature, a build rate, a walk rate, or a combination thereof.

8. The method of claim 1, wherein the control algorithm further comprises a model-based control or a model-free control.

9. The method of claim 8 wherein the model-based control comprises at least one model-based control selected from the group consisting of linear quadratic regulators, model predictive control, and combinations thereof.

10. The method of claim 8, wherein the model-free control is a proportional-integral-derivative.

11. A system comprising:

a bottom hole assembly comprising at least one sensor configured to take at least one measurement; and an information handling system configured to:

divide a wellplan into one or more sections based at least in part on a section detection algorithm and one or more thresholds in real-time during drilling operations;

receive a depth measurement from the at least one sensor, wherein the depth measurement corresponds to a location of a drill bit or a bottom hole assembly;

determine a current section of the wellplan with the section detection algorithm based on a depth measurement to be a vertical section, a tangent section, a curve section, or a lateral section;

identify a target based at least in part on the determined section of the wellplan; and determine one or more steering commands based at least in part on the target and a control algorithm; and direct the bottom hole assembly to advance through a subterranean formation to the target in accordance with the one or more steering commands.

12. The system of claim 11, wherein the information handling system is further configured to identify one or more constraints based at least in part on the current section and determine the one or more steering commands based at least in part on the one or more constraints.

13. The system of claim 11, wherein the one or more thresholds include at least one of a vertical threshold, a lateral threshold, and a dog-leg severity threshold, and wherein the vertical threshold is about 0 to about 3 degrees, the lateral threshold is about 80 degrees to about 95 degrees, and the dog-leg severity threshold is about 0 degrees per 100 feet to about 0.5 degrees per 100 feet.

14. The system of claim 11, wherein the target comprises at least one target selected from the group consisting of a location, an attitude, a curvature, a build rate, a walk rate, or a combination thereof.

15. The system of claim 11, wherein the control algorithm further comprises a model-based control algorithm.

16. The system of claim 15, wherein the model-based control algorithm comprises at least one model-based control algorithm selected from the group consisting of linear quadratic regulators, model predictive control, and combinations thereof.

17. The system of claim 11, wherein the control algorithm is a model-free control algorithm.

18. The system of claim 17, wherein the model-free control is a proportional-integral-derivative.

* * * * *